US008147219B2

(12) United States Patent
Cho et al.

(10) Patent No.: US 8,147,219 B2
(45) Date of Patent: Apr. 3, 2012

(54) MOTOR DIRECT DRIVEN COMPRESSOR SYSTEM

(75) Inventors: Huan-Kuei Cho, Lujhu Township (TW); Ming-Feng Chou, Lujhu Township (TW)

(73) Assignee: Heng Sheng Precision Tech. Co., Ltd., Lujhu Township (TW)

( * ) Notice: Subject to any disclaimer, the term of this patent is extended or adjusted under 35 U.S.C. 154(b) by 286 days.

(21) Appl. No.: 12/706,114

(22) Filed: Feb. 16, 2010

(65) Prior Publication Data

US 2011/0200465 A1 Aug. 18, 2011

(51) Int. Cl.
*F04B 17/00* (2006.01)

(52) U.S. Cl. ..... 417/410.1; 417/423.15; 417/360; 403/359.1; 403/359.6

(58) Field of Classification Search ..... 417/410.1, 417/423.15, 360; 464/182; 403/359.1, 359.2, 403/359.3, 359.4, 359.5, 359.6, 360
See application file for complete search history.

(56) References Cited

U.S. PATENT DOCUMENTS 6,431,654 B1 * 8/2002 LeBegue ..... 299/61
6,431,786 B2 * 8/2002 Fabbri et al. ..... 403/359.1
2002/0122731 A1 * 9/2002 Marioni ..... 417/352

* cited by examiner

*Primary Examiner* — Charles Freay
*Assistant Examiner* — Todd D Jacobs
(74) *Attorney, Agent, or Firm* — Wang Law Firm, Inc.; Li K. Wang

(57) ABSTRACT

A motor direct driven compressor system includes a motor, a coupling and a compressor, and the coupling is coupled between the motor and the compressor, and a second assembling portion, a coupling portion and a metal plate of the coupling are used for connecting a driving shaft of the motor and a transmission shaft of the compressor. With this design, the driving force of the motor can be transmitted to the compressor and provided for the operation of the compressor. In addition, errors produced by the rotation and transmission during the transmission process can be minimized, so that the compressor can be operated accurately and normally.

7 Claims, 3 Drawing Sheets

MOTOR DIRECT DRIVEN COMPRESSOR SYSTEM

BACKGROUND OF THE INVENTION (a) Field of the Invention

The present invention relates to a motor direct driven compressor system, and more particularly to a technology of driving an air-conditioning compressor of an automobile by an electric motor.

(b) Description of the Related Art

Automobile air-conditioning compressor is a key component of an automobile air-conditioning system, whose working environment and conditions are not as good as those of air conditioners in a building or at a home or other fixed air conditioners in the following aspects: 1. The change of thermal load outside the automobile is large, and since the automobile is a moving object, therefore the change of external whether conditions is large; 2. The required air-conditioning load is large, and thus a quick temperature drop is required; 3. The automobile is operated in an environment with vibrations and bumpy roads, and thus the automobile air-conditioning system requires the shock resistance and bumping resistance; 4. The automobile is exposed to direct sunlight most of the time, the thermal load at the driver seat and passenger seats is much larger than a room; 5. There is a large heat loss in the automobile, since it is difficult to insulate heat of an automobile; 6. A high-performance air-conditioner is required for the automobile.

In addition, most automobile air-conditioning compressors are driven by an engine of the automobile, but hybrid vehicles, electric cars and fuel cell cars are driven by an electric generator. Since the rotation speed of the compressor is affected by the rotation speed of the engine, there is a larger charge of rotation speed, varying from idle speed to maximum speed, and thus the automobile air-conditioning compressor requires the following: 1. Good low-speed performance is required, so that a high cooling performance can be provided for a low-speed operation. 2. Low input power is required for a high speed operation to save gas consumption and improve dynamic power. 3. Small volume and light weight. 4. High reliability is required for operations in poor weather conditions, and thus the compressor must be able to resist high temperature and high pressure, and components must be highly vibration resisting and sealed for a high-speed operation of a car on a bumpy road. 5. The operation of the compressor must be stable, steady, low vibrating and low noise, and thus the use of automobile air-conditioning compressor has much stricter limitations over compressors of other types.

At present, most automobiles adopt an internal combustion engine and petroleum (or diesel) as power source, and components including a belt, a belt pulley and the like for driving and turning on the air-conditioning compressor. As the issues of energy crisis and environmental protection become increasingly serious, the aforementioned hybrid vehicles, electric cars and fuel cell cars are introduced to the market. Although the hybrid vehicles use both petroleum and electric power as dual power source, and a petroleum engine is used for driving the air-conditioning compressor, and present technologies integrate the technology of the electric cars, yet the air pollution produced by the petroleum engine still has the air pollution issue, and thus hybrid vehicles are just transitional products only, and definitely required further improvements.

If the technology of home air-conditioning compressors is adopted to substitute the use of automobile air-conditioning compressors, it is very difficult to overcome the aforementioned problems of the strict using environment of the automobile air-conditioning compressor, and obviously the home air-conditioning compressors are not applicable in this case.

Therefore, it is an important subject for related researches and manufacturers to provide an appropriate way of driving an automobile air-conditioning compressor.

SUMMARY OF THE INVENTION

Therefore, it is a primary objective of the present invention to overcome the aforementioned shortcoming and deficiency of the prior art by providing a motor direct driven compressor system having a motor for driving and operating an automobile compressor uses a motor to overcome the air pollution problem caused by internal combustion engine that uses petroleum and diesel as energy source, so as to achieve the environmental protection requirements.

To achieve the aforementioned objective, the present invention provides

Another objective of the present invention is to use a coupling to connect a motor and a compressor, and a second assembling portion, a coupling portion and a metal plate of the coupling are simple components having the easy-to-manufacture, convenient-to-assemble and low cost advantages.

To achieve the foregoing objective, the present invention comprises:

a motor, having a driving shaft installed to a side of the motor, a first cut groove formed at the center of an end of the driving shaft, and a first assembling portion disposed at an external circumference of the same side of the driving shaft;

an automobile air-conditioning compressor, having transmission shaft installed to a side of the automobile air-conditioning compressor and opposite to the driving shaft, and a second cut groove formed at the center of an end of the transmission shaft and opposite to the first cut groove;

a coupling, including a second assembling portion, a coupling portion and a metal plate, wherein the second assembling portion is disposed between the motor and the compressor and installed with the first assembling portion, and an opening is penetrated through the center of the second assembling portion, and the coupling portion is disposed between the motor and the second assembling portion, and the coupling portion includes a plurality of positioning sections disposed on a side of the coupling portion and with an interval apart from each other, and the plurality of positioning sections surround a penetrating hole at the middle of the coupling portion, and the metal plate is disposed between the motor and the coupling portion, wherein a side of the metal plate is embedded into the first cut groove of the motor driving shaft, and the compressor transmission shaft is passed through the opening of the second assembling portion and the penetrating hole of the coupling portion, and another side of the metal plate is embedded into the second cut groove of the transmission shaft, and ends of the transmission shaft and the driving shaft are coupled at the position of the metal plate, and external circumferences of the driving shaft and the transmission shaft are coupled to internal circumferential surfaces of the plurality of positioning sections.

The foregoing and other objectives of the present invention will become apparent with the detailed description of the following preferred embodiment and illustration of related drawings.

Of course, other components or an arrangement of other components of the present invention may vary, but the selected preferred embodiments will be described in details in the specification and illustrated by the drawings.

DETAILED DESCRIPTION OF THE PREFERRED EMBODIMENTS

The technical characteristics of the present invention will become apparent with the detailed description of the preferred embodiments and the illustration of the related drawings as follows.

Figure 1:
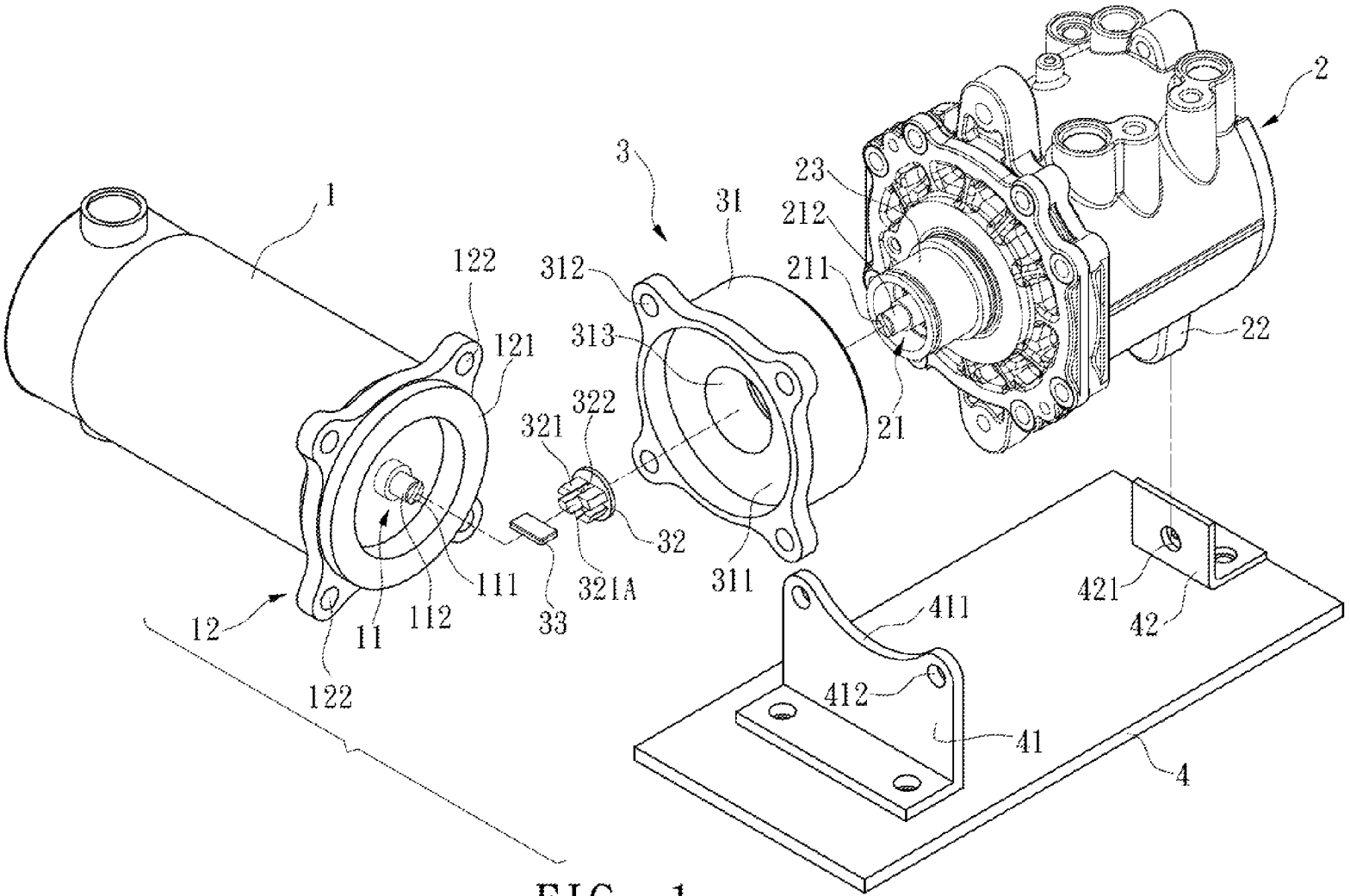
FIG. 1 is an exploded view of the present invention.
Figure 2:
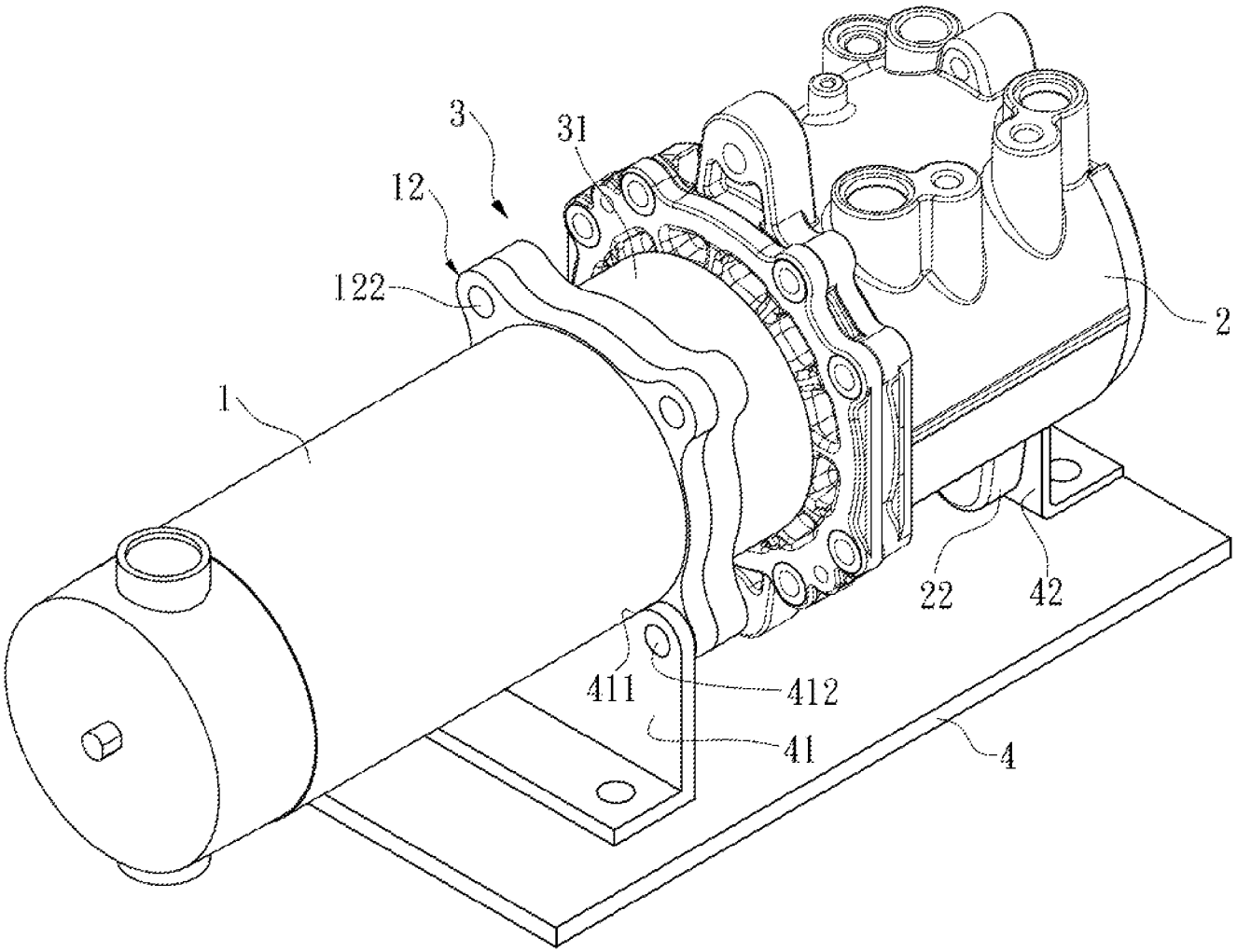
FIG. 2 is a perspective view of the present invention.
Figure 3:
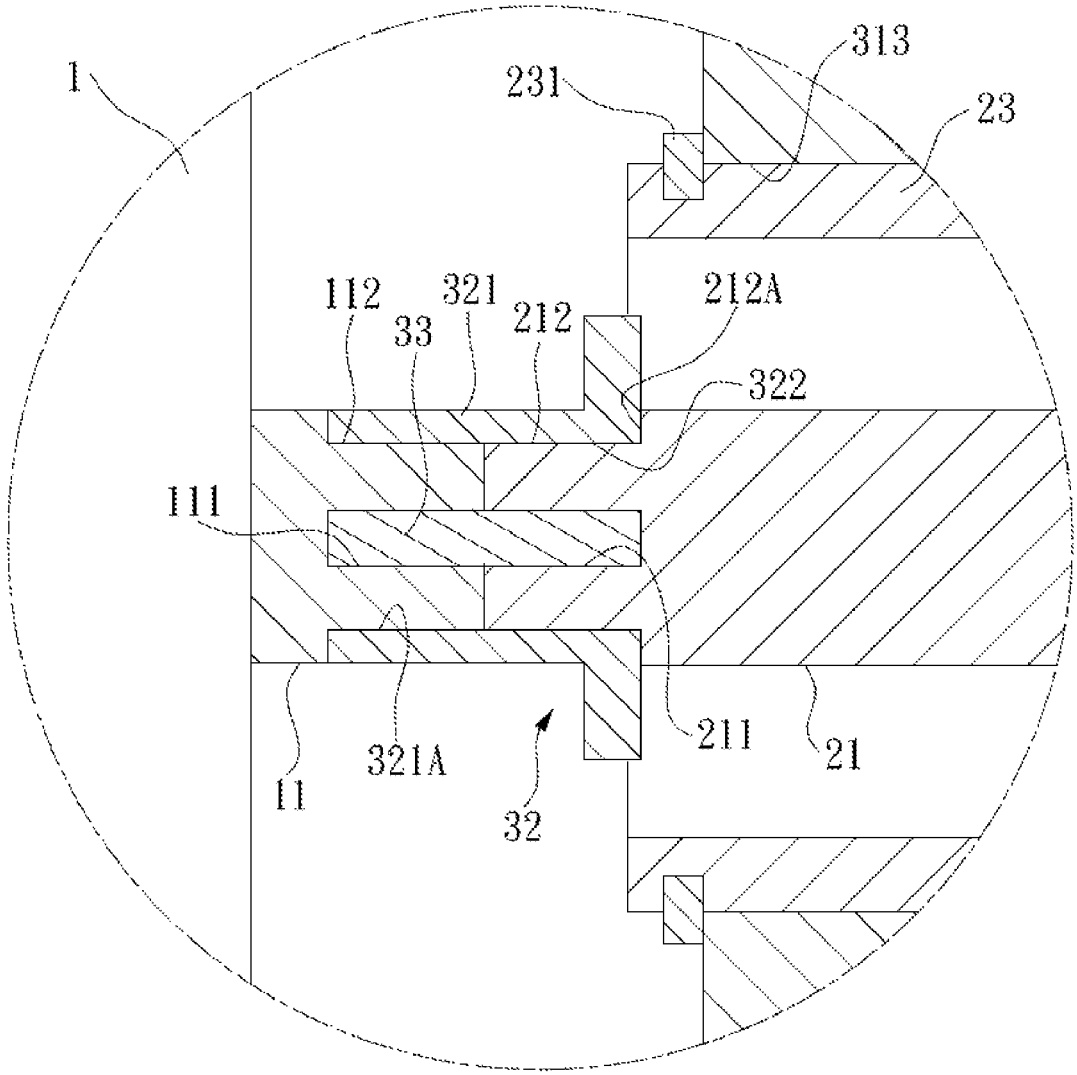
FIG. 3 is a cross-sectional view of a motor and a compressor coupled at the position of a coupling in accordance with the present invention.

With reference to FIGS. 1 to 3 for a structure in accordance with a preferred embodiment of the present invention, the preferred embodiments are used for illustrating the present invention only, but not intended for limiting the scope of the invention.

In FIGS. 1 and 2, a motor direct driven compressor system in accordance with a preferred embodiment of the present invention comprises:

a motor 1, having a driving shaft 11 installed to a side of the motor 1, a first cut groove 111 formed at the center of an end of the driving shaft 1, and a tapered first step portion 112 formed around the periphery of an end of the driving shaft 11, and a first assembling portion 12 formed at the external periphery of the same side of the driving shaft 11 of the motor 1, wherein the first assembling portion 12 of this preferred embodiment has a protruding portion 121 disposed around the driving shaft 11, and a plurality of connecting holes 122 formed at an external periphery of the protruding portion 121, and there are four first connecting holes in this preferred embodiment;

an automobile air-conditioning compressor 2, having a transmission shaft 21 installed to a side of the automobile air-conditioning compressor 2 and disposed opposite to the driving shaft 11 of the motor 1 (such as both ends are coupled with each other), a second cut groove 211 formed at the middle of an end of the transmission shaft 21 and opposite to the first cut groove 111, and a tapered second step portion 212 formed around the periphery of an end of the transmission shaft 21, and the first and second step portions 112, 212 are tapered consistently;

a coupling 3, for coupling the motor 1 and the compressor 2, and including a second assembling portion 31, a coupling portion 32 and a metal plate 33, wherein the second assembling portion 31 is disposed between the motor 1 and the compressor 2 and installed to the first assembling portion 12, and the second assembling portion 31 of this preferred embodiment includes an inwardly concave portion 311 provided for latching and coupling the protruding portion 121 of the first assembling portion 12, and a plurality of second connecting holes 312 formed at an external periphery of the second assembling portion 31, and there are four second connecting holes 312, and the first and second connecting holes 122, 312 can be secured by an external locking element (not shown in the figure) for combining the first and second assembling portions 12, 31, and an opening 313 is formed and penetrated through the center of the second assembling portion 31; and the coupling portion 32 is disposed between the motor 1 and the second assembling portion 31, and the coupling portion 32 includes a plurality of positioning sections 321 disposed on a side of the coupling portion 32 and separated with an interval from each other, and the plurality of positioning sections 321 are disposed around the penetrating hole 322 at the center of the coupling portion 32, wherein the coupling portion 32 of this preferred embodiment is a structure made of plastic and having an appropriate deformation recoverability, and each positioning section 321 is formed by extending outward from the coupling portion 32, and the metal plate 33 is situated between the motor 1 and the coupling portion 32, and a side of the metal plate 33 is embedded into the first cut groove 111 of the motor 1 driving shaft 11, and the metal plate of this preferred embodiment is an iron plate.

In addition, the transmission shaft 21 of the compressor 2 is passed through the opening 313 of the second assembling portion 31 and the penetrating hole 322 of the coupling portion 32, and another side of the metal plate 33 is embedded into the second cut groove 211 of the transmission shaft 21, and ends of the transmission shaft 21 and the driving shaft 11 are coupled at a position of embedding the metal plate 33, and external peripheries of the driving shaft 11 and the transmission shaft 21 are coupled to the internal circumferential surface 321A of the plurality of positioning sections 321;

a base 4, having a first locking portion 41 and a second locking portion 42 disposed on both sides of the base 4 respectively, wherein the first locking portion 41 is coupled and secured to the bottom of the first assembling portion 12, and the second locking portion 42 is coupled and secured to the bottom of the compressor 2, wherein the top of the first locking portion 41 of this preferred embodiment has a concavely curved portion 411 for supporting the bottom of the motor 1, and a third connecting hole 412 is formed separately at position adjacent to both left and right sides of the concavely curved portion 411, and the two third connecting holes 412 correspond to the two first connecting holes 122 at the bottom of the protruding portion 121 and are locked by a locking element (not shown in the figure); and, the second locking portion 42 has a fourth connecting hole 421 provided for coupling and securing a securing portion 22 at the bottom of the compressor 2.

With reference to FIG. 3 for a preferred embodiment of the present invention, the compressor 2 has a circular connecting portion 23 extended from an external periphery of the transmission shaft 21 and inserted into an opening 313 of the second assembling portion 31, and an external wall of the connecting portion 23 is abutted and fixed to an internal wall of the opening 313, and an end of the connecting portion 23 is passed out of the opening 313, and a position limiting element 231 is provided for fixing an end of the connecting portion 23 to the external periphery of the opening 313. In addition, a side of the coupling portion 32 without the positioning section 321 is abutted and coupled to a vertical plane 212A of the second step portion 212 of the transmission shaft 21, and an internal circumferential surface 321A of the plurality of positioning sections 321 is abutted and coupled to the first step portion 112 of the driving shaft 11 and an external circumferential surface of the second step portion 212 of the transmission shaft 21, and an end of the transmission shaft 21 is protruded out from the opening 313 of the second assembling portion 31.

Each component of the motor direct driven compressor system of the present invention and its assembling method are the same as described above. With reference to FIGS. 1 to 3 for the application of the system, the power of the motor 1 is basically supplied by the battery of the automobile or any other method, such that after the motor 1 is started, motive power is transmitted from the driving shaft 11 and the transmission shaft 21 to the compressor 2 to achieve the effect of turning on the compressor 2 to start the air-conditioning. Of course, the second assembling portion 31, the coupling portion 32 and the metal plate 33 of the coupling 3 are provided for overcome slight errors produced by the rotation and transmission between the driving shaft 11 of the motor 1 and the transmission shaft 21 of the compressor 2, wherein the metal plate 33 (which is an iron plate in this preferred embodiment) and the coupling portion 32 have an appropriate deformation recoverability, such that when the aforementioned error of the transmission and rotation occurs, a sufficient space is provided to achieve the buffering effect, so as to maintain a smooth transmission between the driving shaft 11 and the transmission shaft 21, and assure accurate and normal operations of the compressor 2.

In summation of the description above, the motor direct driven compressor system of the present invention uses the motor 1 to drive the automobile air-conditioning compressor 2, so as to provide a method of driving the automobile and a solution of substitute energy, overcome the air pollution issue of traditional internal combustion engine (or engine) using petroleum and diesel as the energy source, and achieve the environmental protection effect.

The technical measures taken by the present invention include the following: The system of the invention comprises the coupling 3, having the second assembling portion 31, the coupling portion 32 and the metal plate 33, and these components come with the advantages of simple structure, easy-to-manufacture, and convenient-to-assemble, and thus incurring a low cost, and providing a high competitiveness to the automobile industry. The present invention also provides the technology of using the motor to drive and turn on the compressor, so as to overcome the present existing problems.

In summation of the description above, the present invention improves over the prior art, and complies with the patent application requirements, and thus the invention is duly filed for patent application.

While the invention has been described by device of specific embodiments, numerous modifications and variations could be made thereto by those generally skilled in the art without departing from the scope and spirit of the invention set forth in the claims.

We claim:

1. A motor direct driven compressor system, comprising:

a motor, having a driving shaft installed to a side of the motor, a first cut groove formed at the center of an end of the driving shaft, and a first assembling portion disposed at an external periphery on the same side of the driving shaft;

an automobile air-conditioning compressor, having a transmission shaft installed to a side of the automobile air-conditioning compressor and opposite to the driving shaft, and a second cut groove formed at the center of an end of the transmission shaft and opposite to the first cut groove;

a coupling, including a second assembling portion, a coupling portion and a metal plate, wherein the second assembling portion is disposed between the motor and the compressor and assembled with the first assembling portion, and an opening is formed at the center of the second assembling portion, and the coupling portion is disposed between the motor and the second assembling portion, and the coupling portion has a plurality of positioning sections disposed on a side of the coupling portion and separated from each other, and the plurality of positioning sections are disposed around a penetrating hole formed at the center of the coupling portion, and the metal plate is disposed between the motor and the coupling portion, and a side of the metal plate is embedded into the first cut groove of the motor driving shaft, and the compressor transmission shaft is passed through the opening of the second assembling portion and the penetrating hole of the coupling portion, and another side of the metal plate is embedded into the second cut groove of the transmission shaft, and ends of the transmission shaft and the driving shaft are coupled with each other at a position of the metal plate, and external peripheries of the driving shaft and the transmission shaft are coupled to an internal circumferential surface of the plurality of positioning sections.

2. The motor direct driven compressor system of claim 1, further comprising a base, and a first locking portion and a second locking portion disposed on both sides of the base respectively, wherein the first locking portion is coupled and secured to the bottom of the first assembling portion, and the second locking portion is coupled and secured to the bottom of the compressor.

3. The motor direct driven compressor system of claim 1, wherein the coupling portion is a structure made of plastic and having an appropriate deformation recoverability.

4. The motor direct driven compressor system of claim 1, wherein the metal plate is an iron plate.

5. The motor direct driven compressor system of claim 1, wherein the first assembling portion has a protruding portion disposed around the driving shaft, and the second assembling portion has an inwardly concave portion for latching and coupling the protruding portion.

6. The motor direct driven compressor system of claim 1, wherein the compressor has a connecting portion extended from an external periphery of the transmission shaft, and the connecting portion is inserted into the opening and abutted against an internal wall of the opening, and an end of the connecting portion is passed out from the opening, and a position limiting element is provided for positioning the end of the connecting portion at an external periphery of the opening.

7. The motor direct driven compressor system of claim 1, wherein the driving shaft and the transmission shaft have tapered a first step portion and a tapered second step portion formed around ends of the driving shaft and the transmission shaft respectively, and a side of the coupling portion without the positioning section is abutted against a vertical plane of the second step portion of the transmission shaft, and an internal circumferential surface of the plurality of positioning sections is abutted against an external circumferential surface of the first and second step portions, and an end of the transmission shaft is protruded out of the opening of the second assembling portion.

* * * * *